US006099338A

United States Patent [19]

Huang

[11] Patent Number: 6,099,338

[45] Date of Patent: Aug. 8, 2000

[54] SECURING MEANS FOR BLADES OF ELECTRICAL PLUG

[76] Inventor: Chyong-Yen Huang, No. 12, Alley 10, Lane 140, Sec. 1, Shing-Sheng South Rd., Taipei, Taiwan

[21] Appl. No.: 09/188,675

[22] Filed: Nov. 9, 1998

[51] Int. Cl.[7] ..... H01R 13/627

[52] U.S. Cl. ..... 439/350; 439/825

[58] Field of Search ..... 200/51.09; 174/51; 439/107, 751, 350, 825, 827

[56] References Cited

U.S. PATENT DOCUMENTS

| | | | |
|---|---|---|---|
| 2,337,735 | 12/1943 | Brus | 173/361 |
| 2,443,797 | 6/1948 | Miller | 173/343 |
| 3,614,715 | 10/1971 | Marx | 339/252 P |
| 4,111,509 | 9/1978 | Novak | 339/14 P |
| 5,411,403 | 5/1995 | Blanche | 439/106 |
| 5,533,915 | 7/1996 | Deans | 439/678 |

*Primary Examiner*—Gary F. Paumen
*Assistant Examiner*—Alexander Gilman
*Attorney, Agent, or Firm*—Rosenberg, Klein & Lee

[57] ABSTRACT

A securing means for blades of an electrical plug, essentially comprised of a plug adapted with two resilient leaves in conjunction with a socket outlet, wherein, on both sides of the blade at its central portion is formed respectively an indent while at where appropriately relative to said gap on both sides to the front section of the resilient leave is separately made a protrusion bending outwardly, and the rear section of said resilient leaf is provided inside the plug; in another preferred embodiment, said two resilient leaves may be respectively embedded into sectional grooves on both sides of the blade; and furthermore in yet another preferred embodiment, a resilient covering leaf is formed as a protrusion at the corresponding to the plug gap respectively on both sides of the front section and a side leaf provided and connected to the rear section while the resilient covering leaf and the blade may be further riveted with a conductor from a plug adapter so that once the plug is inserted into the socket; and in yet another preferred embodiment, a through gap may be provided at the wider edge of the plug and one end of the resilient leaf is made an integral part of a casing to be snapped into the plug while allowing the resilient protrusion extend from the front end of the casing to properly extend and rest in the gap; said protrusion formed by the resilient leaf having resilient tension or the protrusion formed by said resilient leaf slightly expands and holds firmly against the top of the inner wall inside the outlet of the socket, and thus to secure both of the plug and the socket in position.

17 Claims, 21 Drawing Sheets

SECURING MEANS FOR BLADES OF ELECTRICAL PLUG

FIELD OF INVENTION

The present invention relates to a means of securing the blades of electric plug, and more particularly, to a plug structure having its protrusion from each resilient leaf member adapted to bite the top inner wall in the outlet of a socket to secure the plug-in.

BACKGROUND OF THE INVENTION

Electric plug is a necessity in our daily life. Blades of the electric plug of the prior art are secured by the clamping force provided by conductors in the socket. At initial, the blades may be well held in position; however, later, they tend to get loosening up and falling off accidentally. Such interruption of power supply may cause disturbance to the user particularly when he is operating certain electric appliance or information system. In addition, it may also affect the stability of such appliance or system. In case of a three-in-one conversion plug with only one pair of blades, a sudden power interruption is not uncommon when such blades fail to be secured in the socket due to the fatigue of the blades or when any plug is pulled off from the conversion plug, the power supply to the other two plugs are interrupted at the same time.

In some types of three-in-one conversion plug(9) as illustrated in FIG. 20, its blades(92) are made rotatable for certain degrees, wherein, a rotator(91) allowing proper rotation and stop at a position as desired is accommodated in a recess provided at the edge of the conversion plug(91), said blades(92) and conducting tongues(93) are each directly bound with a rivet(94) and said blades(92) are respectively connected to said conducting tongues; since the blades(92) are linked to the rotator(91), by turning the blades(92), the rotator(91) rotates accordingly and the conversion plug can be plugged into the outlet depending on the angle as desired by the user. However, the direct binding of the blades(92) and the conducting tongues(93) each with a rivet(94) usually would wind up in that the contact between the blade(92) and the conducting tongue(93) either gets too tight or too loose. As a result, when the rotator(9) is moved by turning the blades(92), it becomes difficult to turn the blades(92) or blades fall loosen easily even with a slight touch making the turning very awkward.

Therefore, a modified version of the conversion plug(9) is further provided with a packing(95) at where corresponding to the joint of the blade(92) and the conducting tongue(93) as illustrated in FIG. 12. In addition, a rivet is used to penetrate through the conducting tongue(93), the packing (95) and the blade(92) for connection. The modified conversion plug though prevents the insertion of the blades(92) from getting too tight or too loose by reducing the friction generated from the rotation of the corresponding conducting tongue(93) of the blade(92) with the packing(95), the process to connect the conducting tongue(93), the packing(95), which is a very small part, and the rivet(94) is very complicate and extra attention is required, thus the modified version prevents effective cost reduction due to increased man-hour.

SUMMARY OF THE INVENTION

The primary object of the present invention is to provide a securing structure for the plug blades essentially by a plug adapted with a resilient leaf, wherein, each of said blades is formed a gap on both sides to its middle section and the resilient leaves are each made in a form of protrusion bending externally at where appropriately at the front section on both sides corresponding to the gap provided on the blade, and said resilient leaf is provided on the peripheral of the rear section of the blade with the rear section of the resilient leave provided in the plug;

Another object of the present invention is to provide a securing structure for the plug blades by setting two resilient leaves into and securing on one end of a gap provided on both sides of the blade.

Another object yet of the present invention is to apply the resilient leaf on a conversion plug by having a gap formed on both sides and a hole penetrating through the rear section of each blade; at each side of the front section of the resilient leave is made in a shape of convex, a side leaf is connected to the rear section of the resilient leaf and a protrusion with a through hole is provided in the center of said side leaf; or a through gap is provided at the wider edge of the plug and one end of the resilient covering leaf is made an integral part of a casing corresponding in size to the wider edge of the plug, the casing extends flat and forward with a convex protrusion extending from the end of the flat section of the casing, so that upon the assembly, the resilient covering left is inserted and held in the plug and the protruding front end of the casing properly extends and rests in the gap.

Therefore, when the plug of the present invention is inserted into the outlet, the resilient leaf having elastic tension is set in and secured in the top inner wall inside the outlet of the socket to give the following benefits:

1. The plug can be safely and securely held in place in the socket.
2. Apply only a comfortable force is sufficient to separate the plug from the socket.
3. If adapted to a three-in-one conversion plug, pulling of any plug out of it will not affect the other two plugs.
4. If adapted to a three-in-one conversion plug with rotatable blades, the packing in the prior art can be waived, thus to save man-hour and facilitate the rotation.

DETAILED DESCRIPTION OF THE INVENTION

Figure 1:
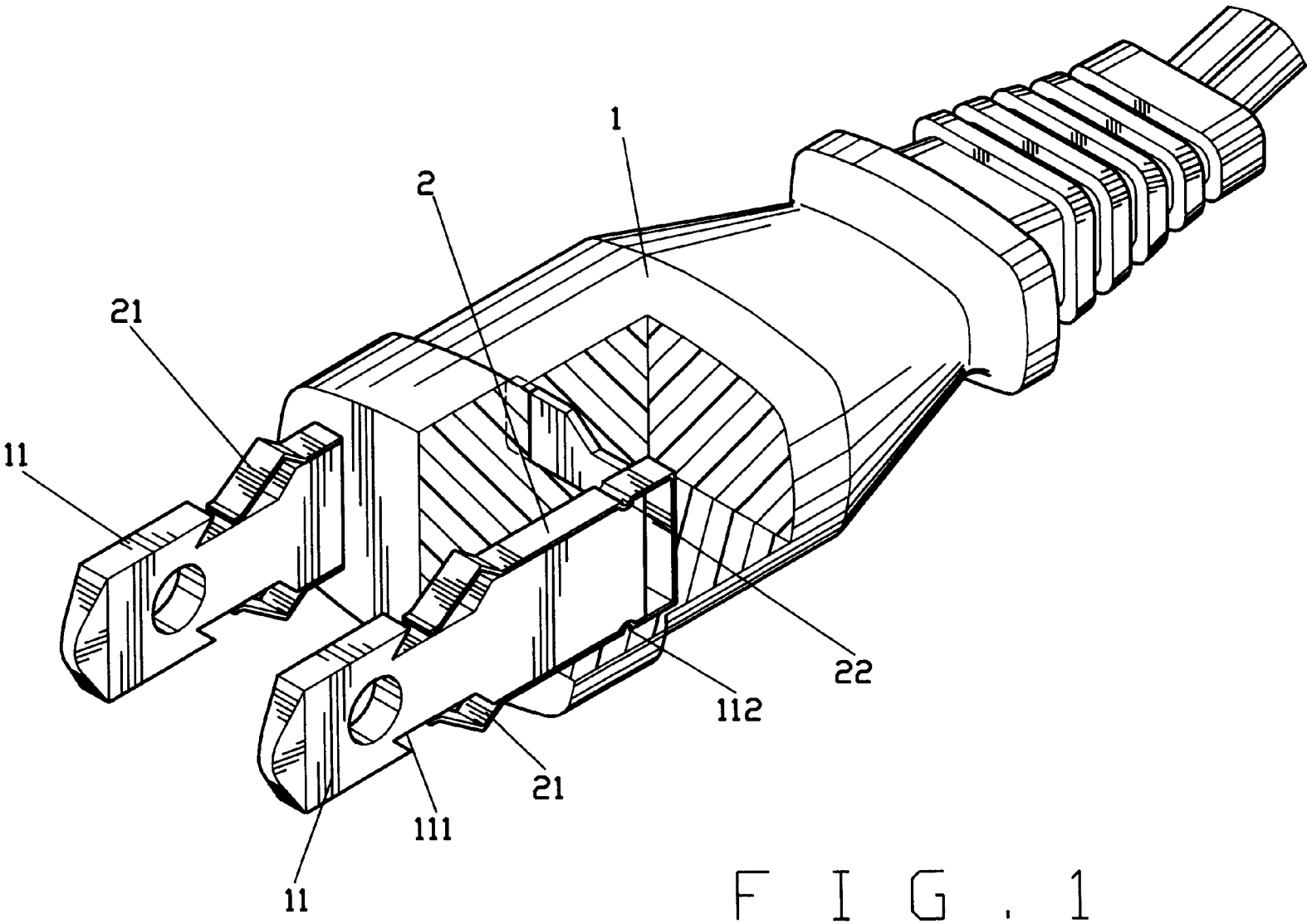
FIG. 1 is an elevation (partially sectional)view of the first preferred embodiment of the present invention.

Referring to FIG. 1, the first preferred embodiment of the present invention is essentially comprised of a plug(1) adapted with a resilient leaf(2), wherein, on both sides at the middle section each is formed with a gap(111), and a recess(112) each on both sides of the rear section of a blade(11) provided appropriately to the plug(1); said resilient leaf(2) refers to one having the same width as the thickness of the blade(1) of the plug(1) and in this preferred embodiment, at where appropriately on both sides of the rear section corresponding to the recess(112) to the blade(1) of the plug(1), the resilient leaf(2) is made in a U shape(though other shapes are also possible), at where appropriately on both sides of the front section corresponding to the gap(111) of the blade(11) is formed with a protrusion(21) bending outwardly, and a groove(22) is formed at the rear section corresponding to the recess(112) to the blade(1) of the plug(1).

Figure 2:
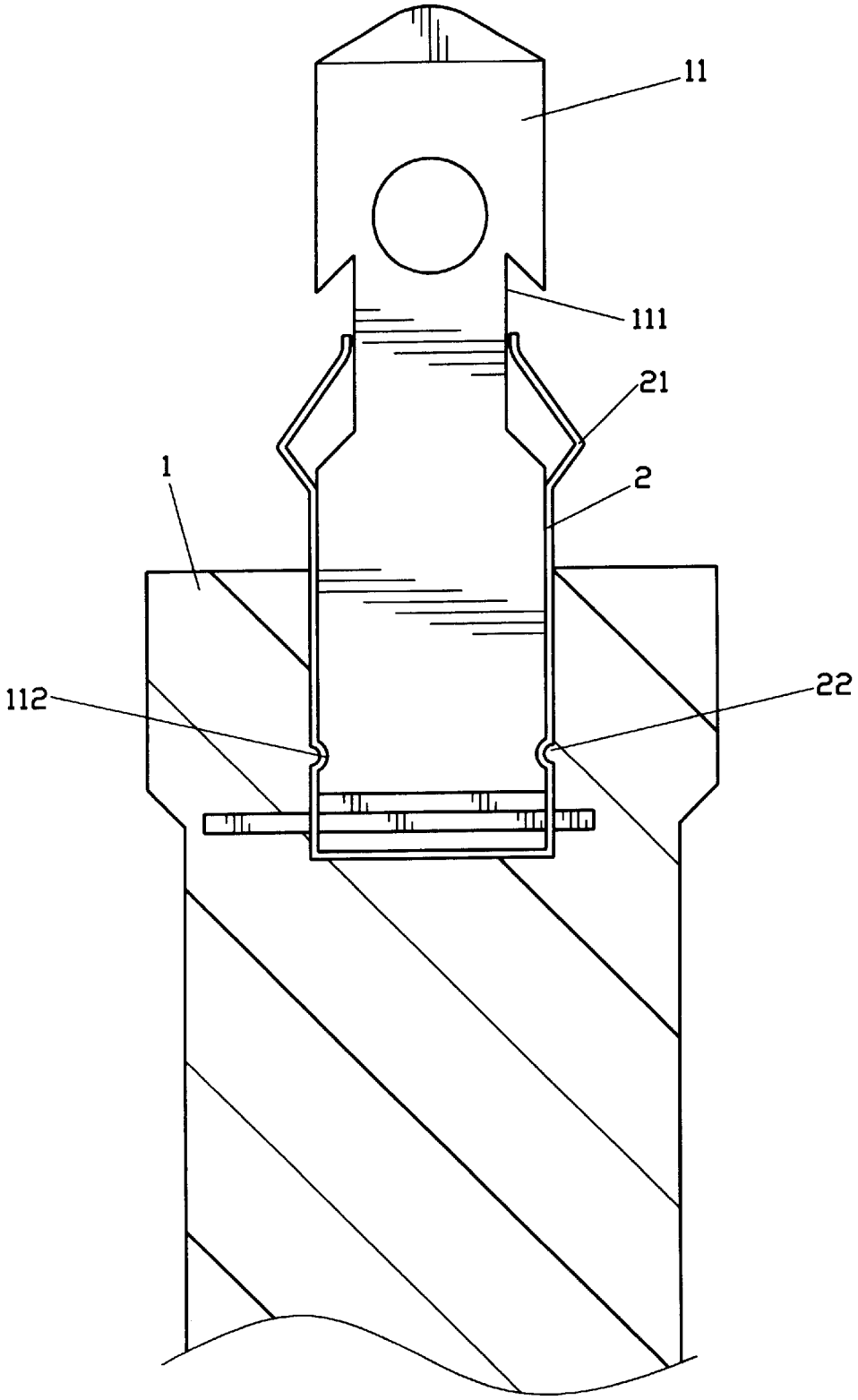
FIG. 2 is a sectional view of the first preferred embodiment of the present invention as assembled.

When the preferred embodiment is assembled as illustrated in FIG. 2, the resilient leaf(2) is provided to the peripheral of both sides to the blade(11) of the plug(1) with the recess(12) of the blade(11) accommodated by the groove (22) of the resilient leaf(2), and the front end(i.e. the free end) of the resilient leaf(2) extends into the gap(111) of the blade(11), wherein, both rear sections of the blade(11) and the resilient leaf(2) are provided in the plug(1) to form the structure of a plug having its blades(11) each provided on both sides a resilient leaf(2).

Figure 3:
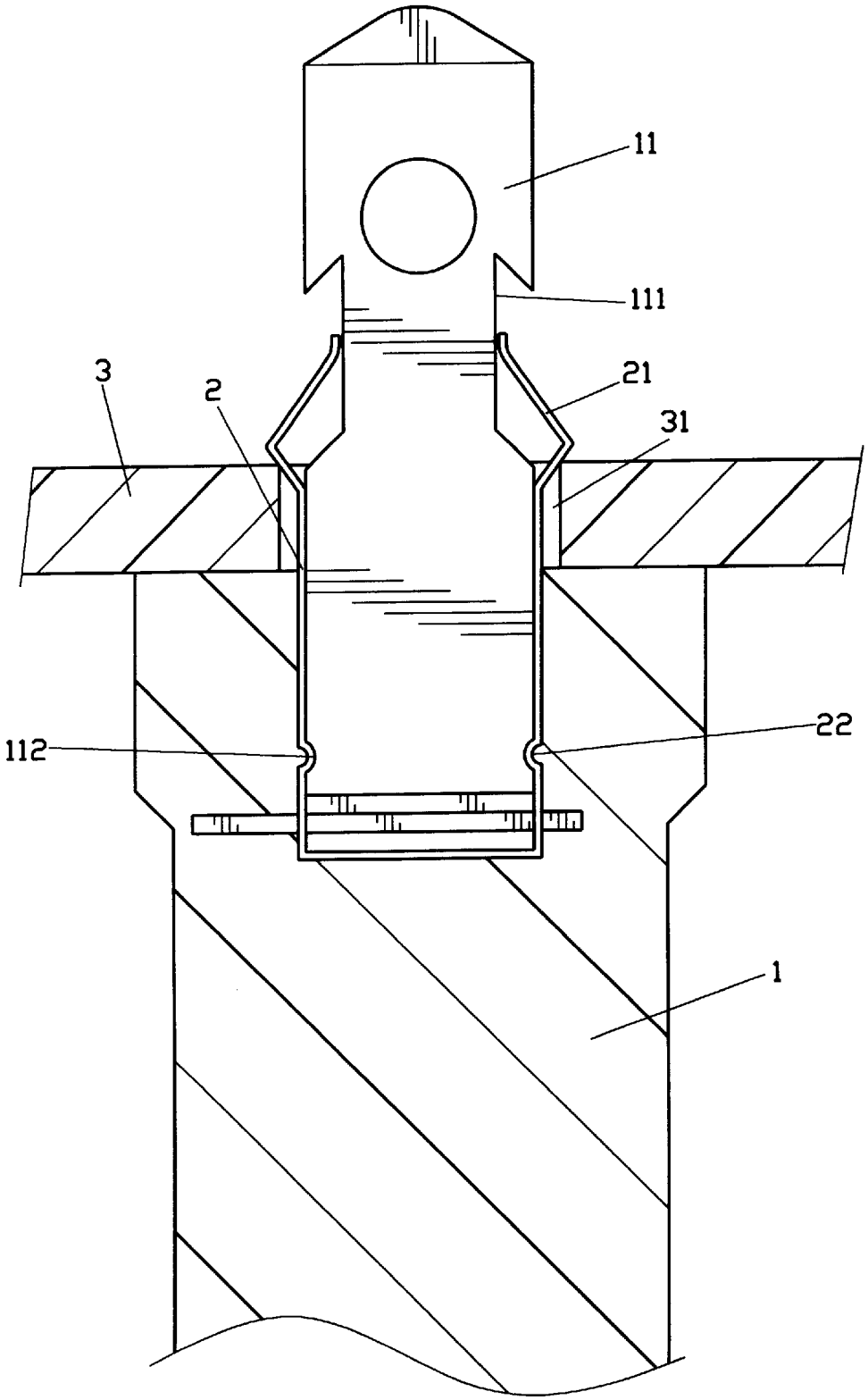
FIG. 3 is a view of the first preferred embodiment of the present invention in practice.

In practice as illustrated in FIG. 3, of the first embodiment of the present invention, the blades(11) of the plug(1) are respectively set in the outlets(31) of a socket(3), wherein the protrusion(21) provided to the resilient leaf(2) on both sides of the blade(11) is slightly extended to set in the top inner wall of the outlet(31) of the socket(3) to secure the blade(11) in place so that the plug(1) will not be easily to disengage from the socket(3) when applied with a mild external force; if the plug(1) is to be pulled out, the application of a proper force could straighten up the protrusion(21) of the resilient leaf(2) that is confined by the inner wall of the outlet(31) and thus the plug(1) can be comfortably removed. In the process of inserting or pulling out the plug(1) as aforesaid, the protrusion(21) of the resilient leaf(2) retreats inwardly and extends due to the compression while the space required for such extension is provided by the gap(111) to the blade(11) of the plug(1).

Figure 4:
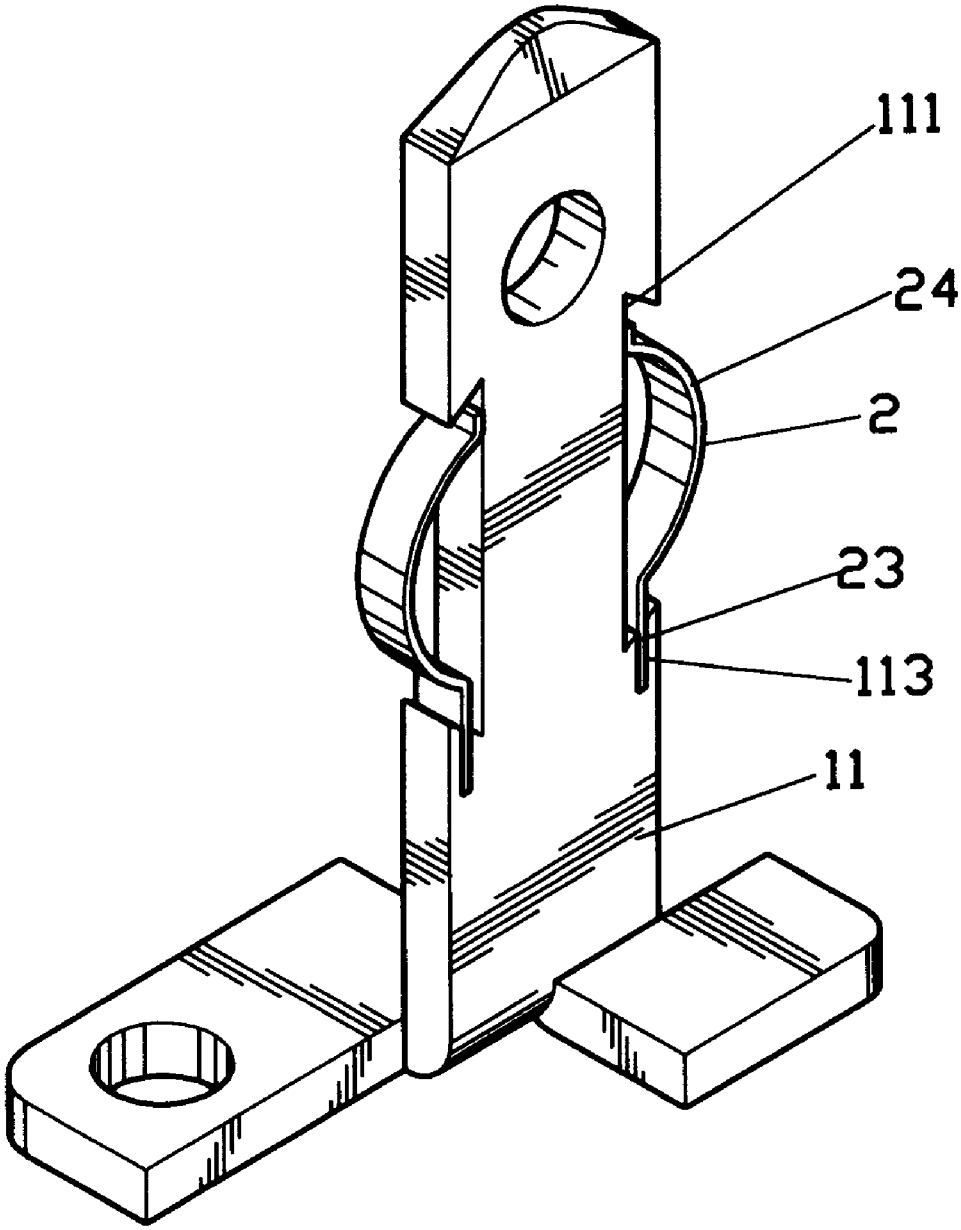
FIG. 4 is a view of elevation view of the second embodiment of the present invention.

Now referring to FIG. 4, both of the plug(1) and the resilient leave(2) in the second preferred embodiment have been modified as that the gap(111) is each formed on both sides of the middle section of the blade(11), and a sectional groove(13) each is provided at where appropriately on the end corresponding to said gap(11); the resilient leaf(2), made of a sheet or wire material, is provided with a securing section(23) and an arc protrusion(24) extending from said section(23); said protrusion(24) is also made with elastic resilience.

Figure 5:
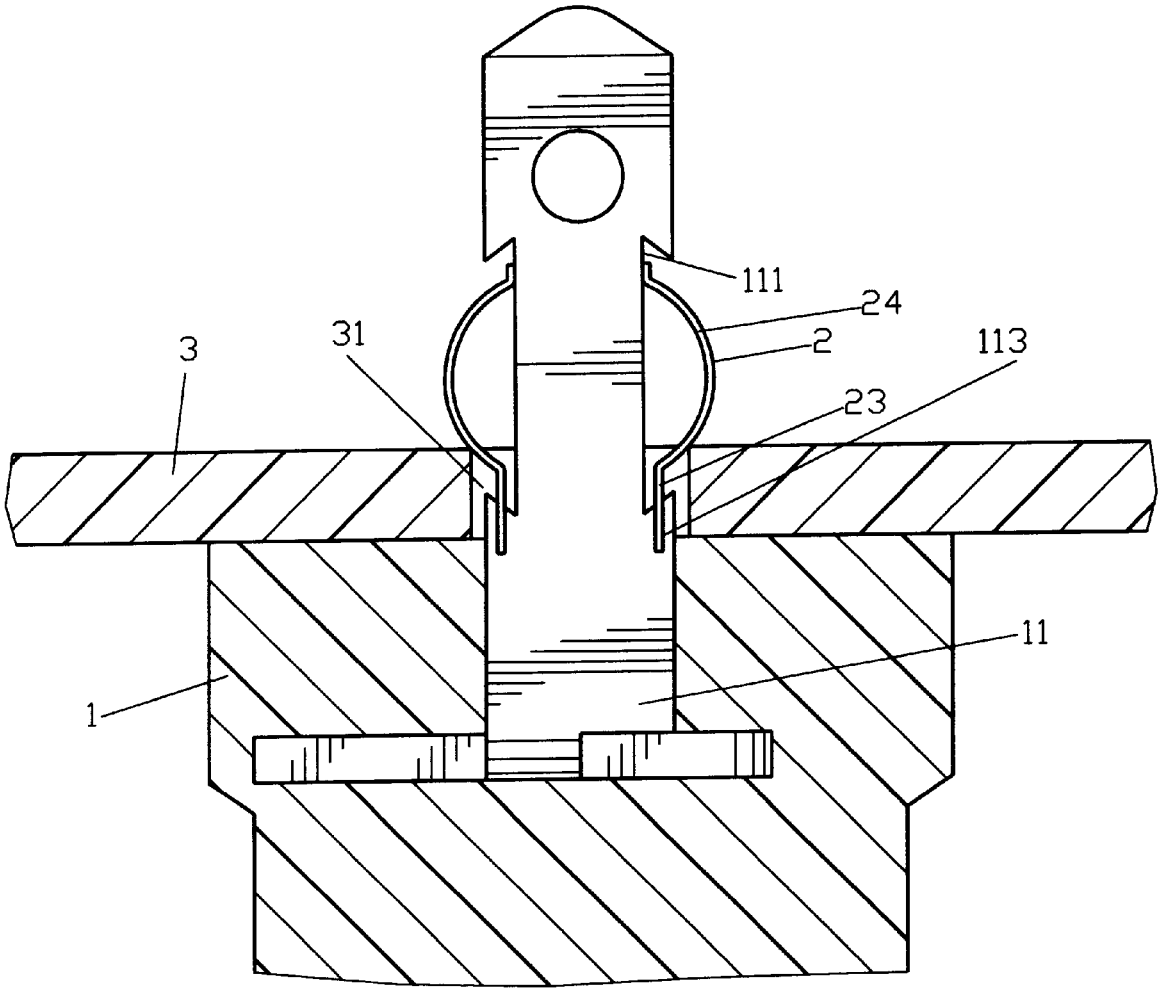
FIG. 5 is a view of the second preferred embodiment of the present invention in practice.

In the second preferred embodiment of the present invention, said resilient leaf(2) is set by the securing section (23) with a proper tension in the sectional groove(113) of the blade(11); the protrusion(24) of the resilient leaf(2) located at the gap(111) of the blade(11) and the terminal of said protrusion(24) extends into said gap(111), so if said resilient leave(2) is desired to be permanently set in and secured in the blade(11), the sectional groove(113) of the blade(11) can be pressed and to secure by the transformation property of the material. As illustrated in FIG. 5, when the blade(11) is inserted into the outlet(31) of the socket(3), the resilient leaf(2) extends slightly and sufficiently to set and hold against in the inner wall of the outlet(31) of the socket(3) to secure the blade(11) of the plug(1) so that the blade(11) will not easily fall out of the outlet(31) of the socket(3) simply by any mild external force; on the contract, if the plug(1) is to be pulled out, the application of a proper and comfortable force will retreat the protrusion(24) as confined by the inner wall of the outlet(31) of the socket(3) of the resilient leaf(2) which is loaded with elastic tension into the gap(111) of the blade(11), thus to remove the plug(1).

Figure 6:
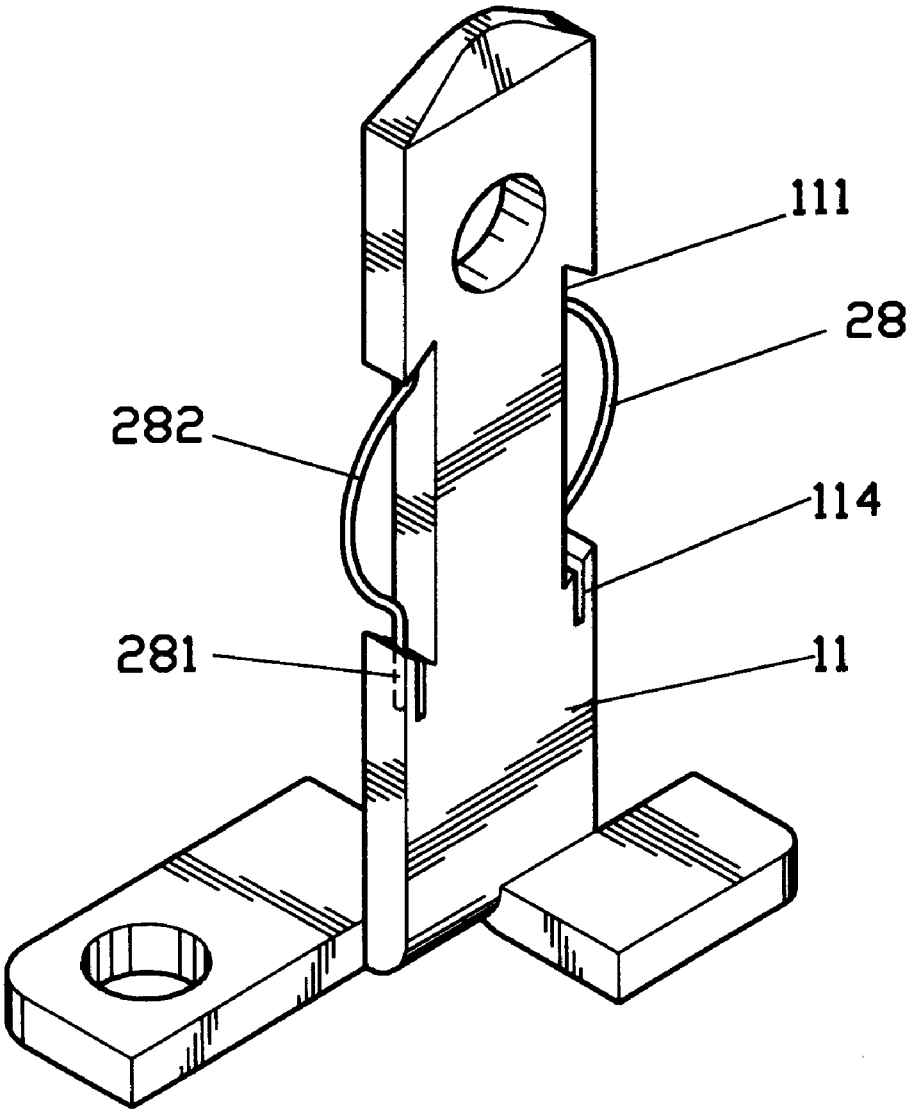
FIG. 6 is an elevation view of the third preferred embodiment of the present invention.

Referring to FIG. 6 of the third preferred embodiment of the present invention, the resilient(2) leaf is substituted with an elastic wire material(28) having higher elastic coefficient, wherein an accommodation trunk(114) is each provided at where appropriately on the corresponding gap(111) to both sides of the blade(11) and the elastic wire material(28) refers to an arc protrusion(282) extending from a securing section (281) so that by setting the securing section(281) of the elastic wire material(28) with proper tension into the accommodation trunk(114) of the blade(11), the protrusion(282) of the elastic wire material(28) extends into the gap(111) of the blade(11), and the accommodation trunk(114) of the blade (11) may be pressed to secure the elastic wire material(28) to the blade(11).

Figure 7:
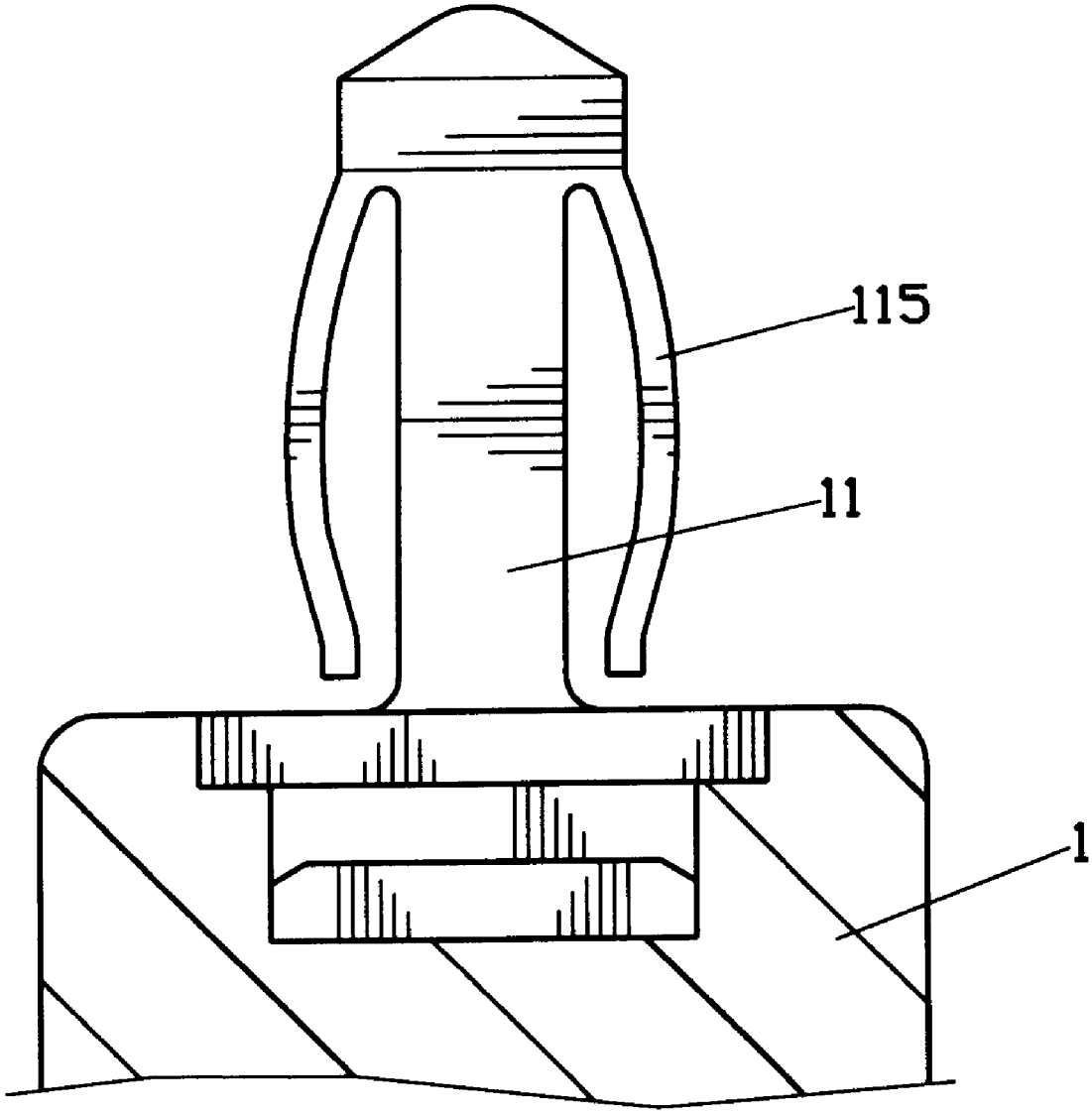
FIG. 7 is a (partially sectional) view of the fourth preferred embodiment of the present invention as assembled.

Furthermore, for the blade(11) and the resilient leaf(2) of the third preferred embodiment of the present invention, in addition to choosing the type of setting in, the elastic wire material (28) may be made as an integral part as illustrated in FIG. 7 of the fourth preferred embodiment of the present invention by forming an elastic clamping part(115) on both sides of the blade(11).

Figure 8:
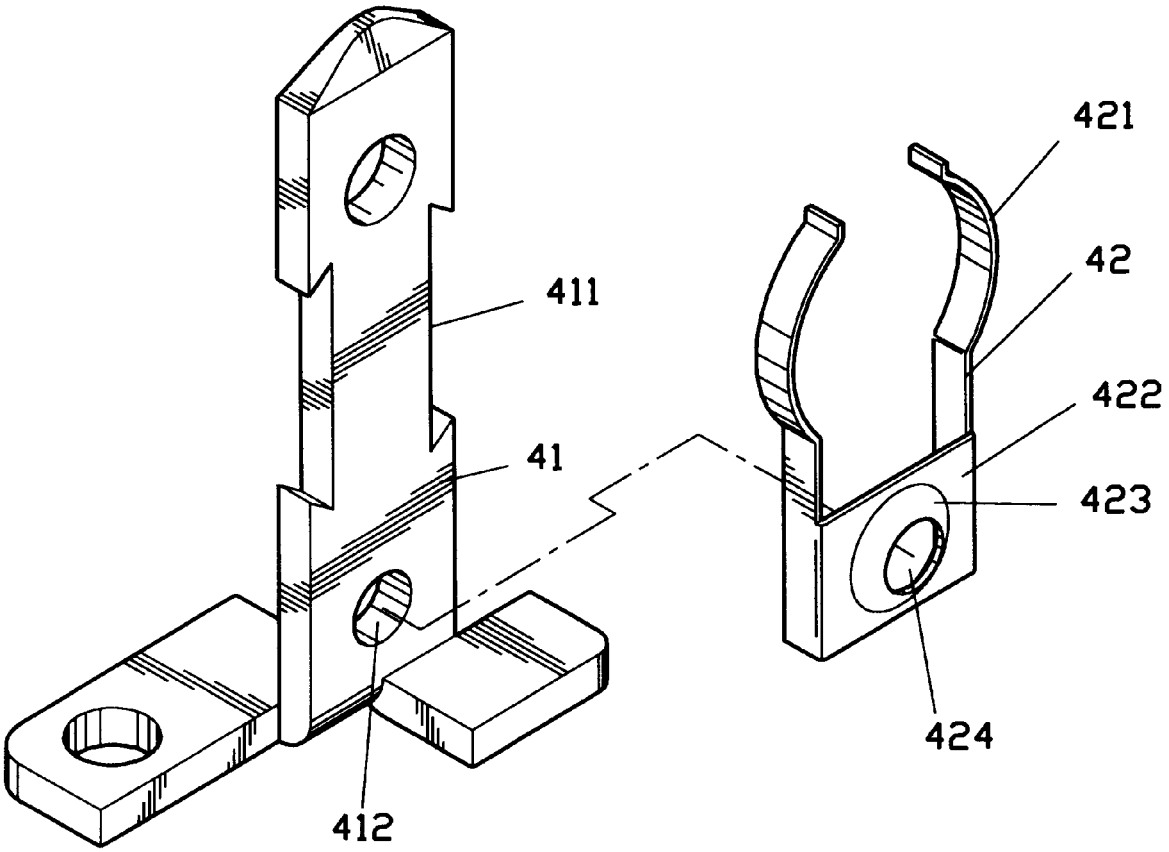
FIG. 8 is an elevation view of the fifth preferred embodiment of the present invention.
Figure 9:
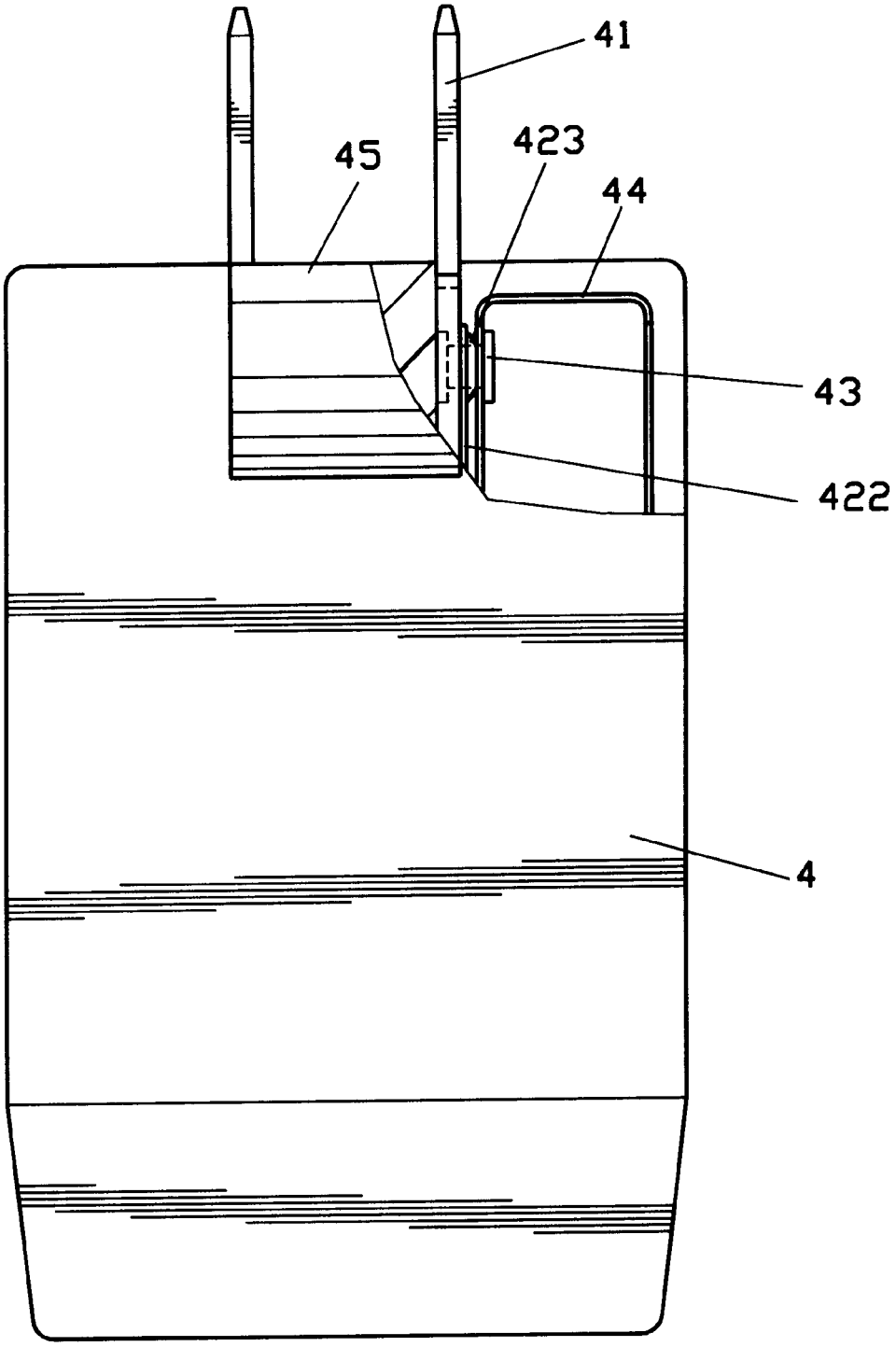
FIG. 9 is a (partially sectional) view of the fifth preferred embodiment of the present invention as assembled.
Figure 10:
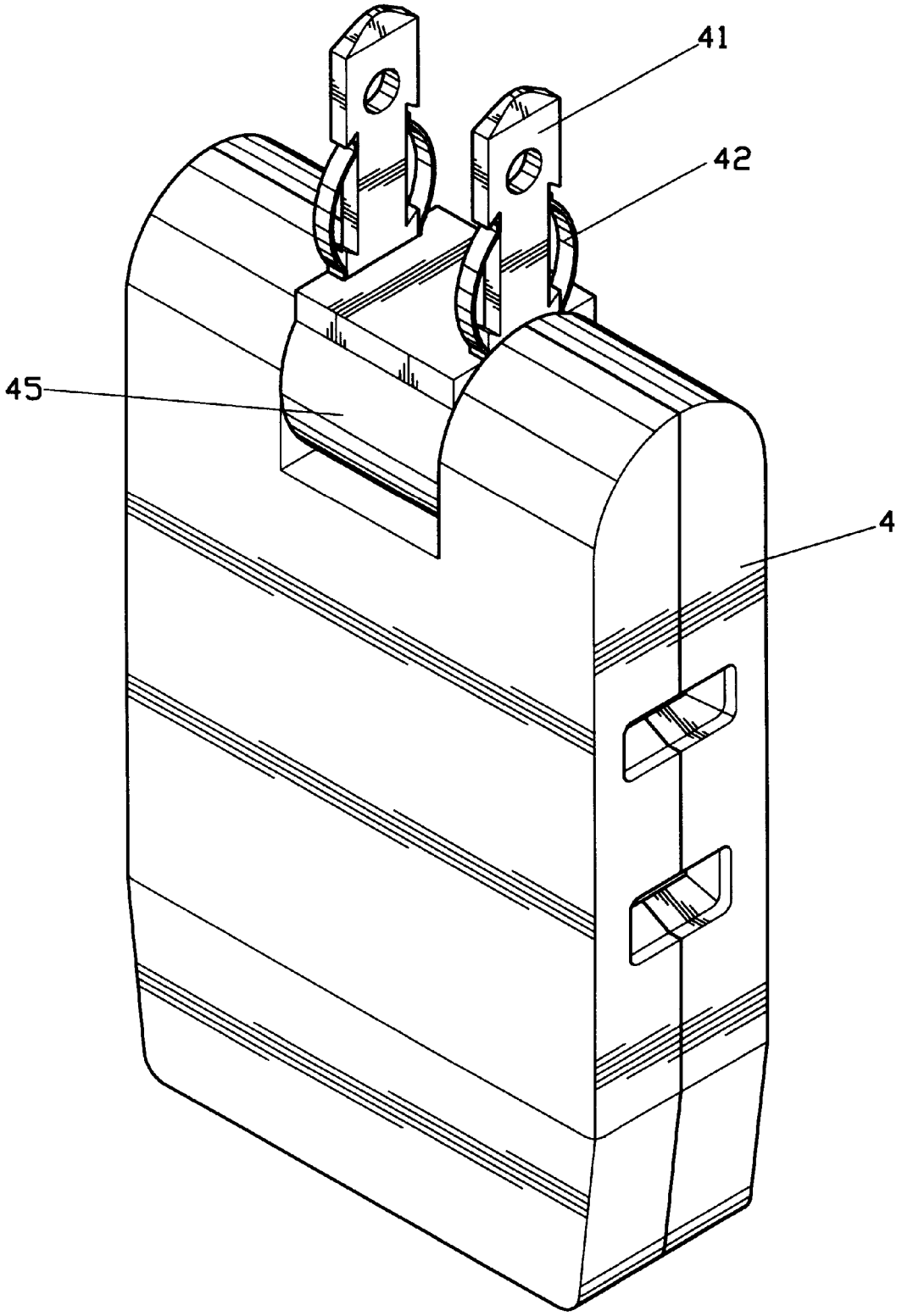
FIG. 10 is an elevation view of the appearance of the fifth preferred embodiment of the present invention as assembled.

Referring to FIG. 8, wherein the fifth preferred embodiment of the present invention, the blade(11) and the resilient leaf(2) are adapted to have the construction as illustrated in FIG. 8; it is comprised of a blade(41) and a resilient covering leaf(42), wherein, a gap(411) is each formed respectively at the middle section on both sides of the blade(41), and a through hole(412) is provided at the rear section of the blade(41); on both sides of the front section of the resilient covering leaf(42) at where corresponding to the gap(411) of the blade(41) is provided with a protrusion(421) bending outwardly, and a side leaf(422) is connected to the rear section of said resilient covering leaf(42), another protrusion (423) is formed at the center of the side leaf(422) which is bored with a hole(424) in corresponding to the through hole(412) of the blade(41); so that when assembled as illustrated in FIGS. 9 and 10, said blade(41) and said resilient covering leaf(42) can be adapted to a three-in-one conversion plug by capping the resilient covering leaf(42) over one side of the blade(41) with the hole(424) from the protrusion(423) aligned to the through hole(412) of the blade(41) while the protrusion(421) of the resilient covering leaf(42) extends into the gap(411) of the blade(41), then a rivet(43) is used to penetrate through a hole reserved for a conductor(44), the hole(424) in the protrusion(423) of the resilient covering leaf(42) to join the through hole(412) of the blade(41) so that the blade(41) and the conductor(44) can be electrically connected. Whereas the contact between the side leaf(422) of the resilient covering leaf(42) relies only upon the contact between the protrusion(423) and the conductor(44), the blade(41) can be comfortably turned around to drive a rotatable member(45). Such a construction does not require the adaptation of a packing(95), thus to effectively save the assembly cost and to relatively upgrade the production competition edge. In addition, the type available for the protrusion(423) is not inclusive, other types such as nipples or any other convex can be adapted to the preferred embodiment of the present invention while yielding the same well facilitated operation of the turning.

Furthermore, any mechanical processes with the equivalent effects (such as by welding) to secure the resilient leaf(2) onto the side of the blade(11) other than the set-in type as illustrated in FIGS. 4 and 6, and the integral type as illustrated in FIG. 7 fall wherein the scope of this application. The protrusion(24) to the resilient leaf(2) is certainly not limited to the shape as illustrated of the accompanying drawings of the present invention, arc and bending angle are shapes that can be included in the preferred embodiment of the present invention, i.e. any preferred embodiment that allows the receiving by the gap(111) of the blade(11) due to compression by external force and permits the restoration to the form of protrusion once such force is relieved is included in the scope of the present invention.

Now referred to FIG. 11, wherein, the blade(51) and the resilient covering leaf(2) are modified in the present invention as follows:

A through gap(511) is provided at the blade(51) at the wider edge near to the plug(5), or said gap(511) may be also made an integral part to a channel with one open side thus locate on either side of the blade(51).

Figure 11:
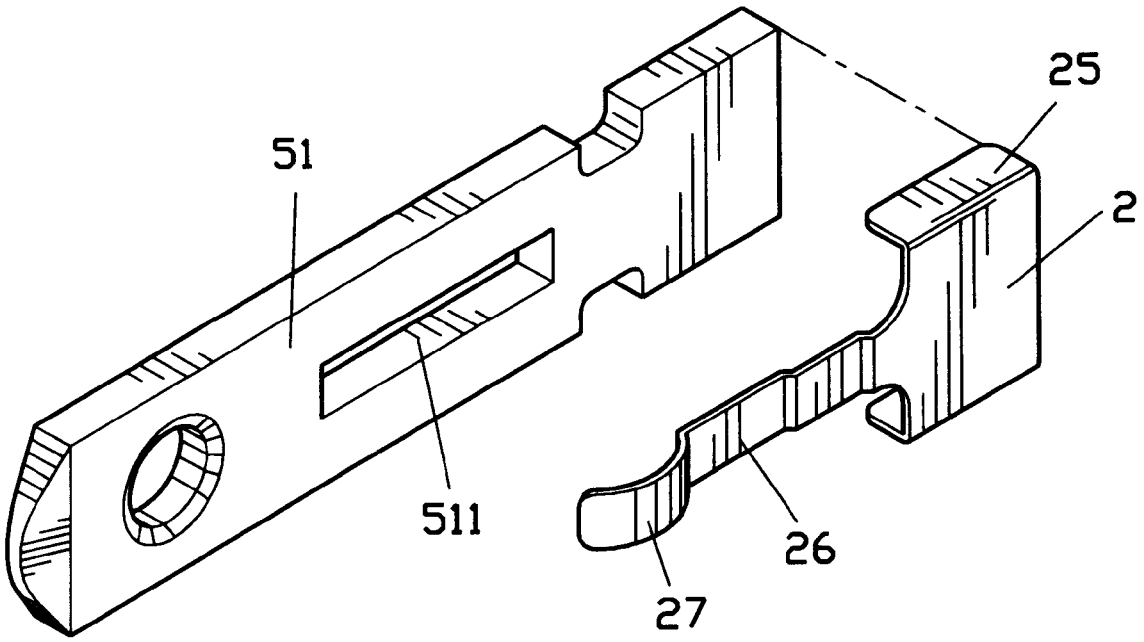
FIG. 11 is an elevation view of the sixth preferred embodiment of the present invention.

The resilient leaf(2) is formed using a thin plate or wire material and is made in "r1" shaped casing (25) where extends for a flush section(26) and its front end is made a resilient convex protrusion(27), wherein, the flush section (26) of said resilient leaf(2) can be partially made in certain length for a concave as illustrated in FIG. 11; so that when assembled, said section(26) can conveniently fit into said gap(511); or saving such convex, the entire flush section(26) is directly attached to the blade(51) of the plug(5).

Figure 12:
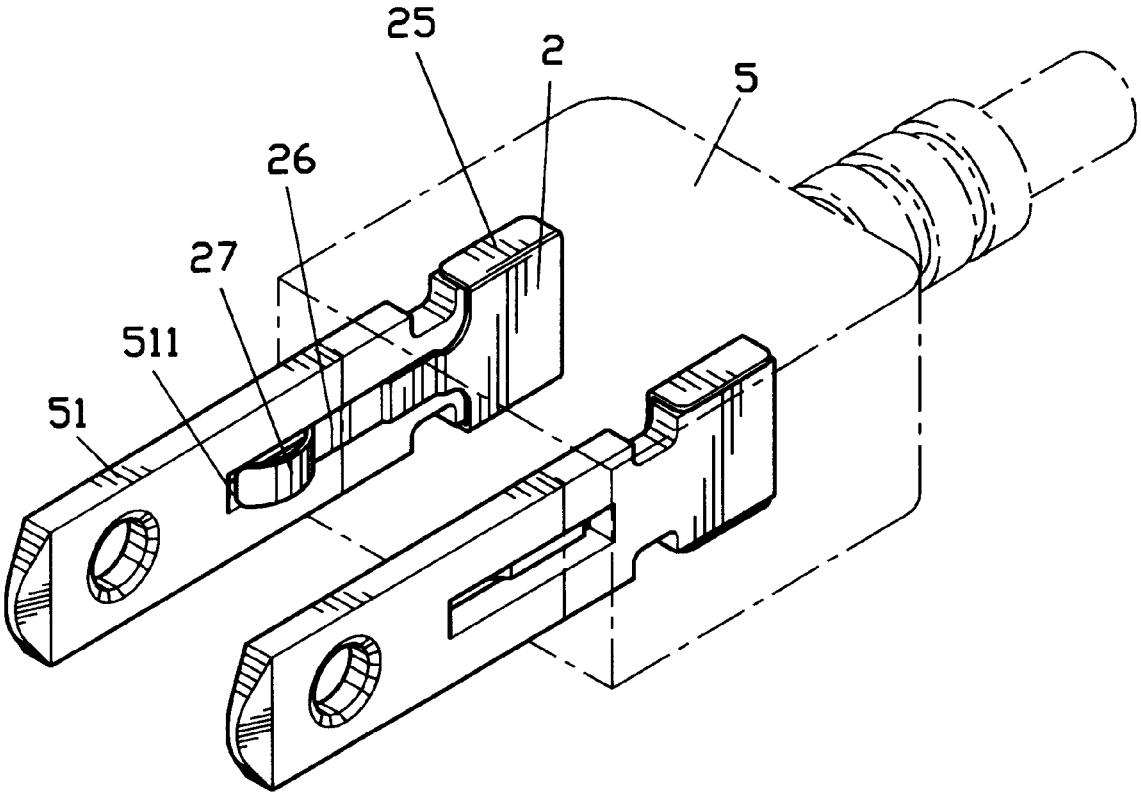
FIG. 12 is a view of the assembly of the sixth preferred embodiment of the present invention.
Figure 13:
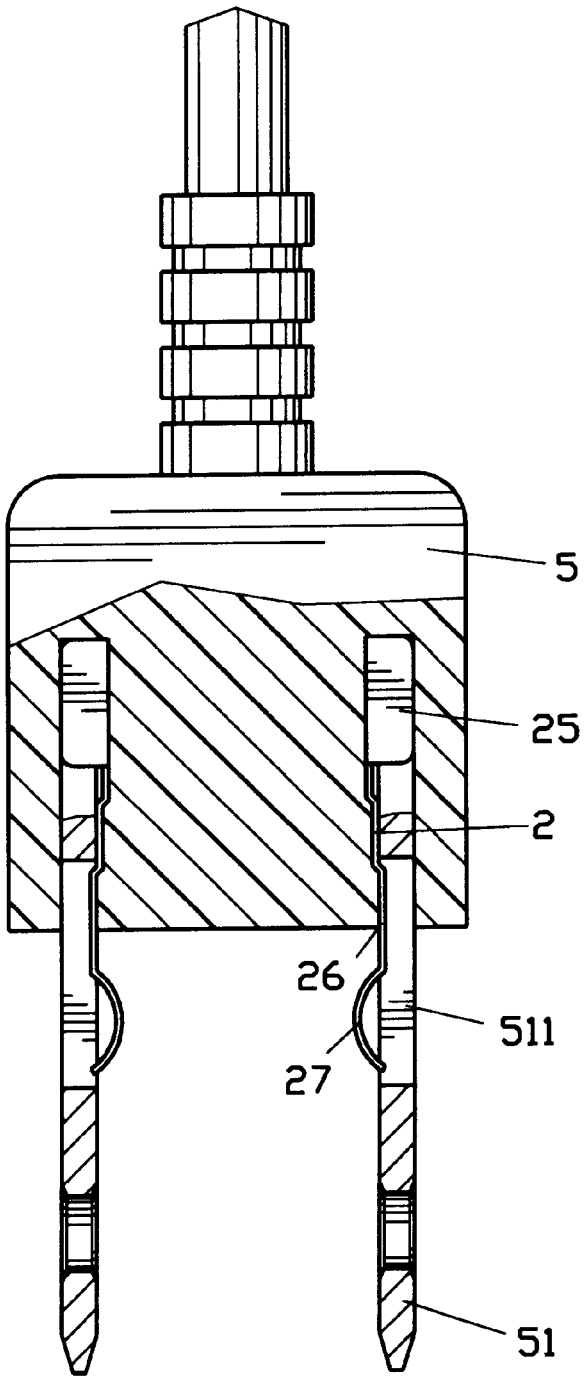
FIG. 13 is a sectional view of the assembly of the sixth preferred embodiment of the present invention.
Figure 14:
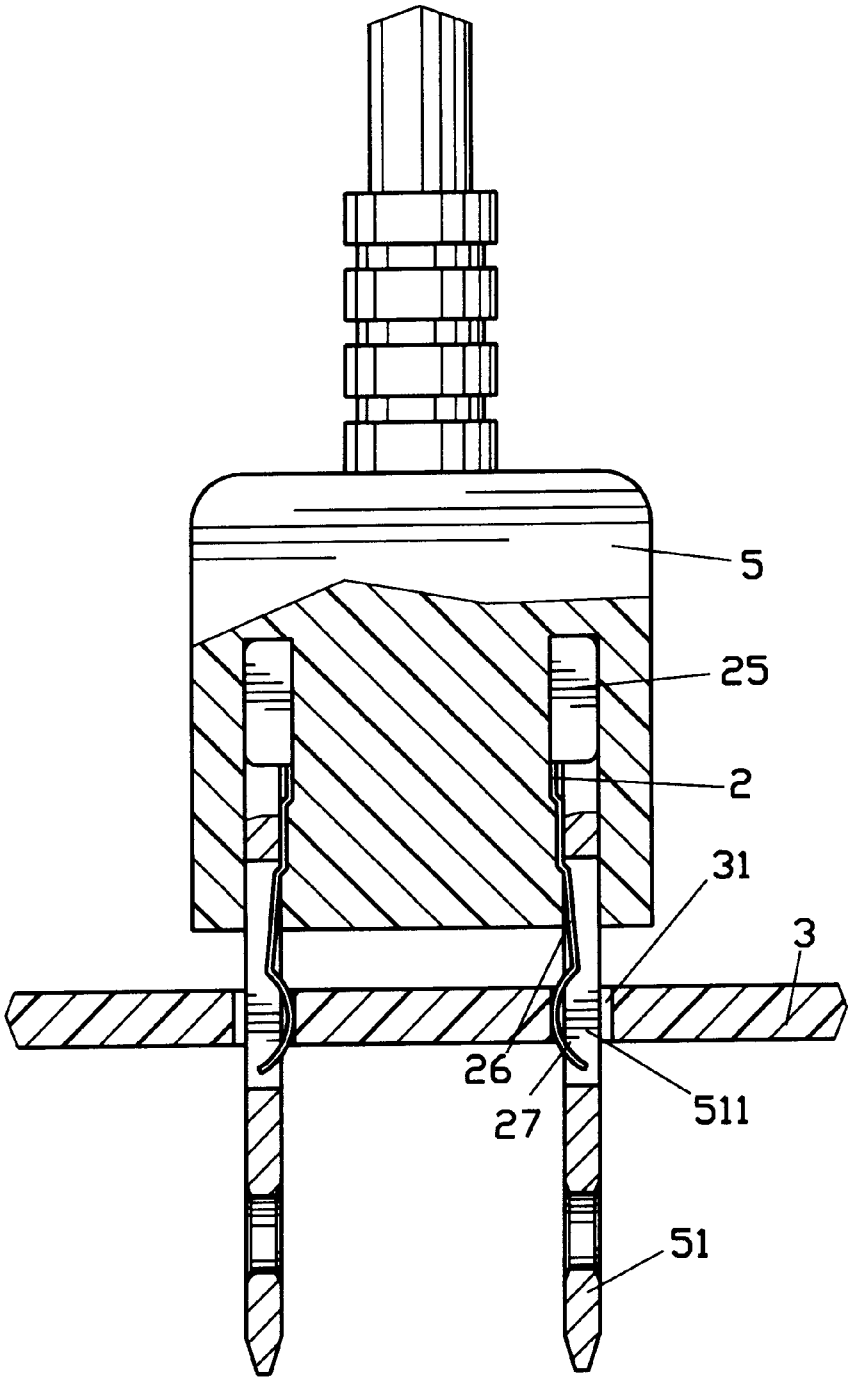
FIG. 14 is a schematic view of the sixth preferred embodiment of the present invention(1).
Figure 15:
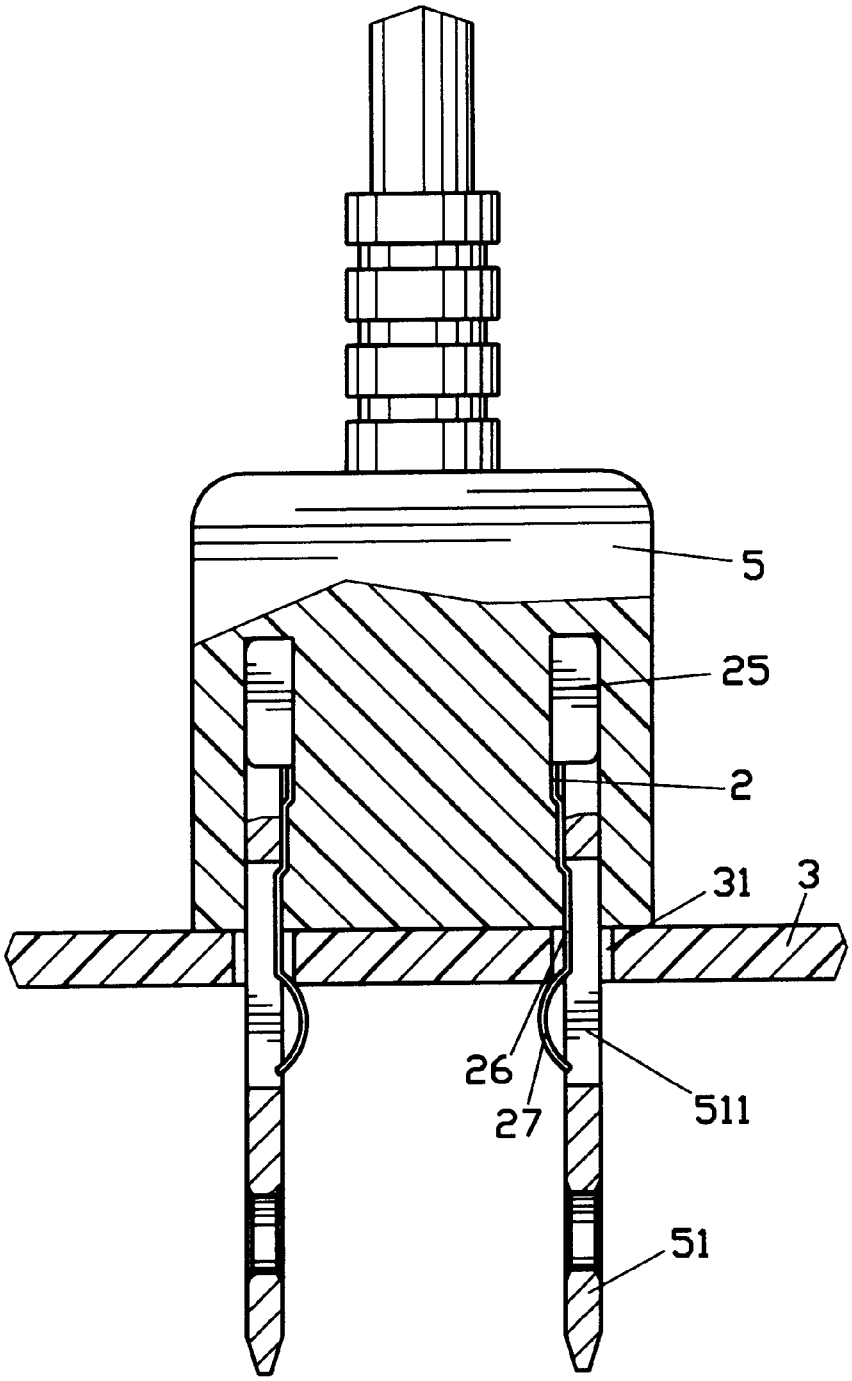
FIG. 15 is another schematic view of the sixth preferred embodiment of the present invention(2).

As illustrated in FIGS. 12 and 13, the casing(25) of the resilient leaf(2) holds against the corresponding inner side of the wider edge to the blade(51) of the plug(5) (or the casing(25) may be snapped into and held to the corresponding outer side of the wider edge to the blade(51)), and embedded in the plug(5) while the flush section(26) fits in the gap(511) and maintains at the same plane of the wider edge of the blade(51), and said protrusion (27) emerges from with its front end penetrating into the gap(511). Furthermore, if the gap(511) of the blade(51) is provided a shorter one, said flush section(26) can be directly attached to the plane of the wider edge to the blade(51) and the protrusion(27) emerges from the gap(511); so that by referring to FIGS. 13 and 14, when the blade(51) is inserted into the outlet(31) of the socket(3), the protrusion(27) is subdued and deformed towards the gap(511) for being pressed by the outlet(31) due to the resilient leaf(2) along with the insertion of the blade(51) into the outlet(31) of the socket(3), then the blade(51) is able to penetrate and extend through the outlet (31); as illustrated in FIG. 15, once the outlet(31) accommodates the entire blade(51), the protrusion(27) of the resilient leaf(2) immediately restores to its protruding shape due to the nature of its material. Therefore, the protrusion (27) fits perfect onto the wall of the inner edge of the outlet(31) to the socket(3) to firmly hold the blade(51) in position, and it will not be easily falling off the outlet(31) of the socket(3) when applied with a mild external force.

Figure 16:
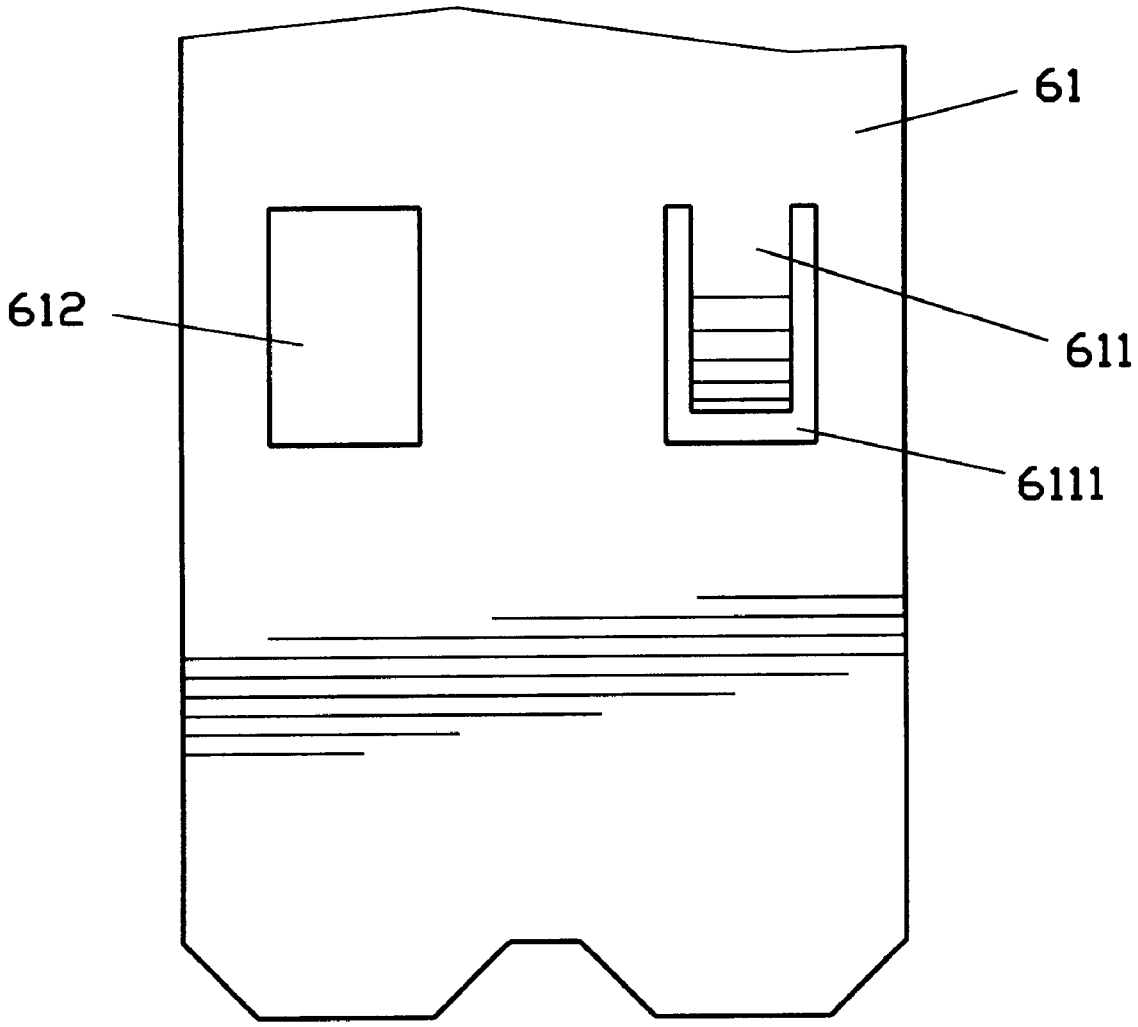
FIG. 16 is a view of the structure of the seventh embodiment of the present view.
Figure 17:
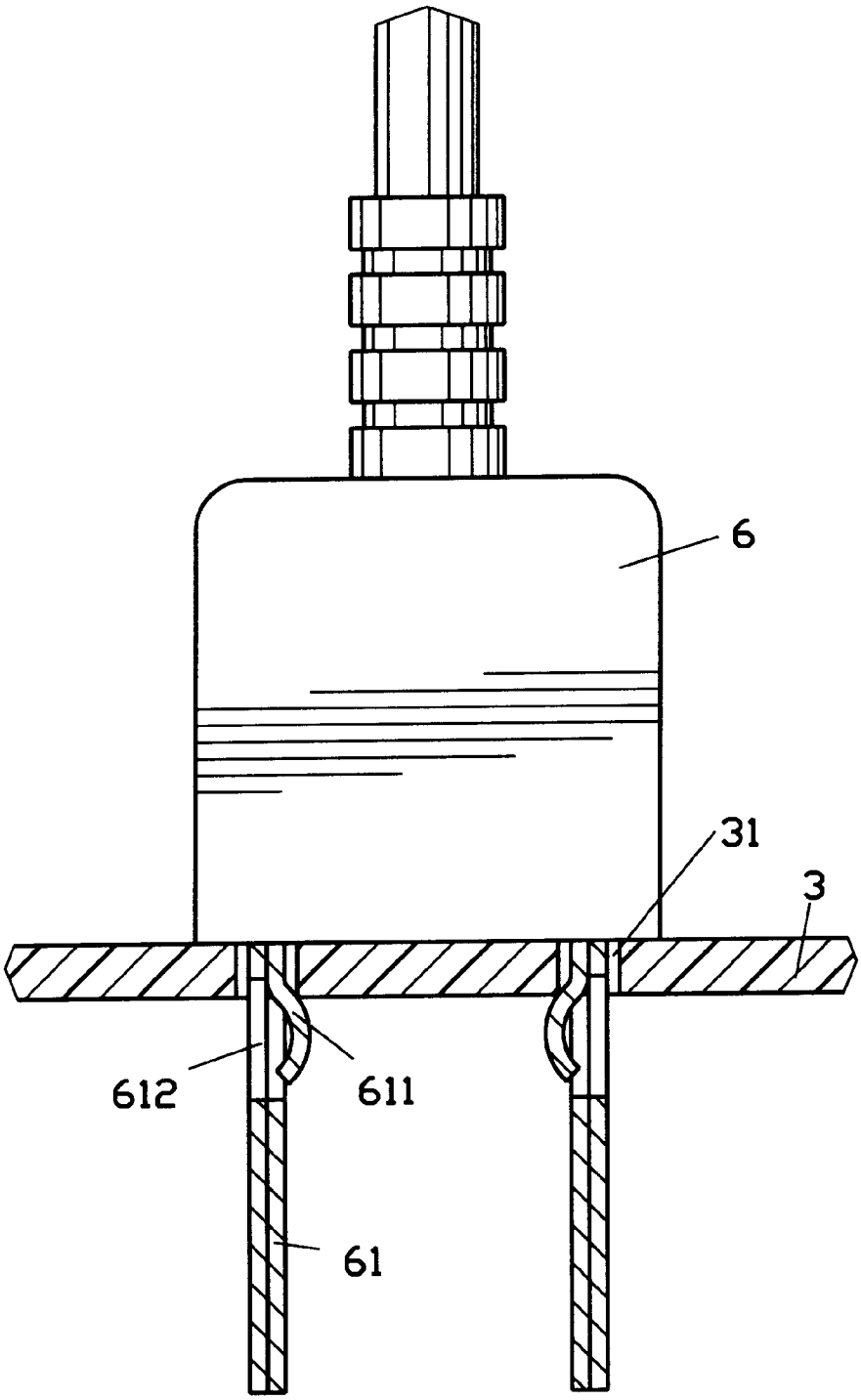
FIG. 17 is a view of the assembly of the seventh embodiment of the present view.

There are some types of the blade to the plug that is made by folding thin sheet materials inwardly. In the present invention, as shown in FIGS. 16 and 17, an end edge is pressed at where appropriately on a sheet material which is connected to the sheet material and slightly protruding outwardly a set-in tongue(611) which to its peripheral is provided with opening(611) other than the connecting end. Said set-in tongue(611) is resilient when pressed due to its protruding form; and a through gap(612) is reserved on the sheet material at where corresponding to said tongue(611) to accommodate the extended tongue(611). In practice, a blade (61) to the plug(6) is formed by folding inwardly and attaching to each other of the folded portions of the sheet material so that said tongue(611) may just extend into the gap(612) and slightly protrude from the end face of the sheet material to achieve positioning result by the force of resilient expansion.

Figure 18:
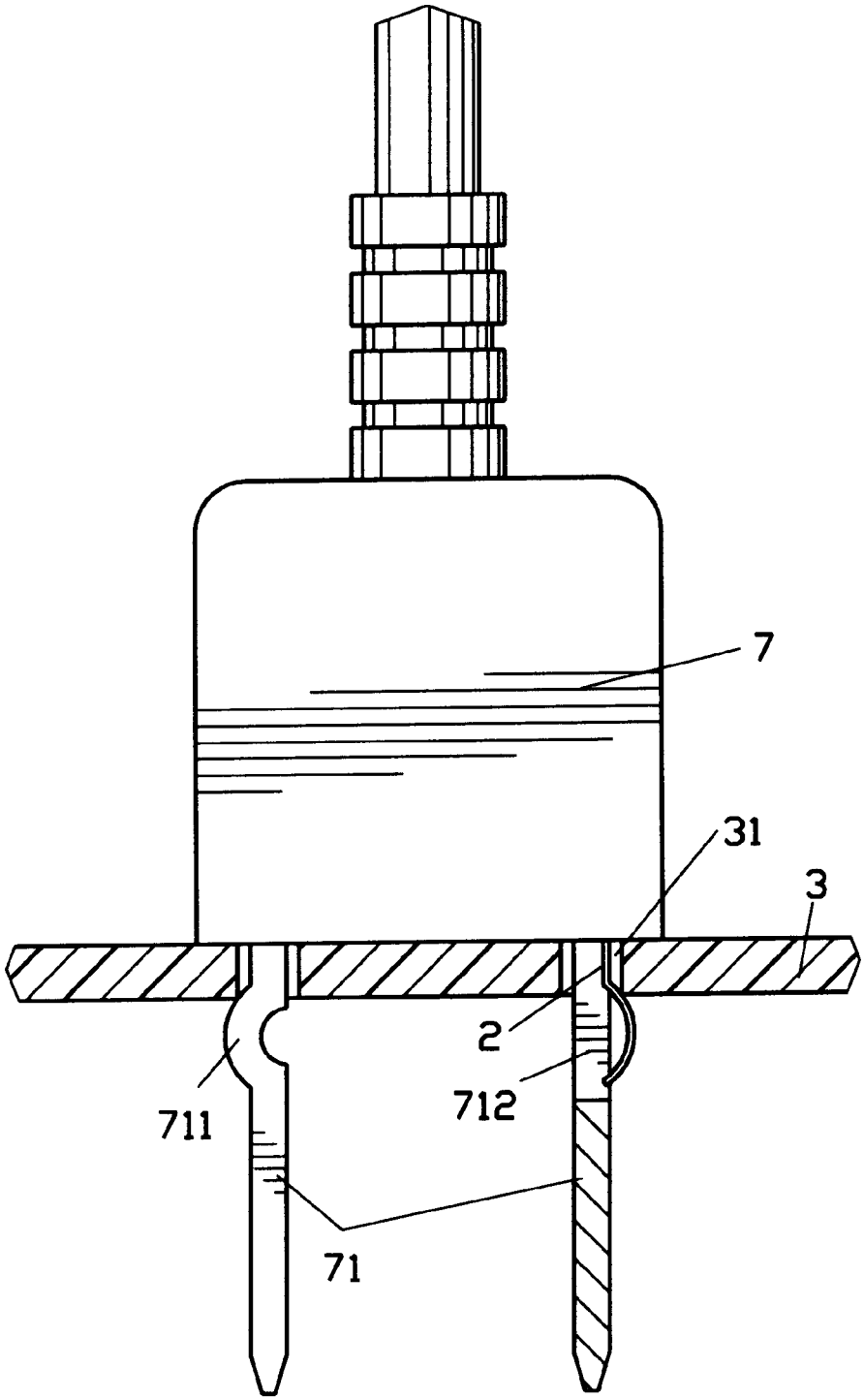
FIG. 18 is a schematic view of the eighth embodiment of the present invention.
Figure 19:
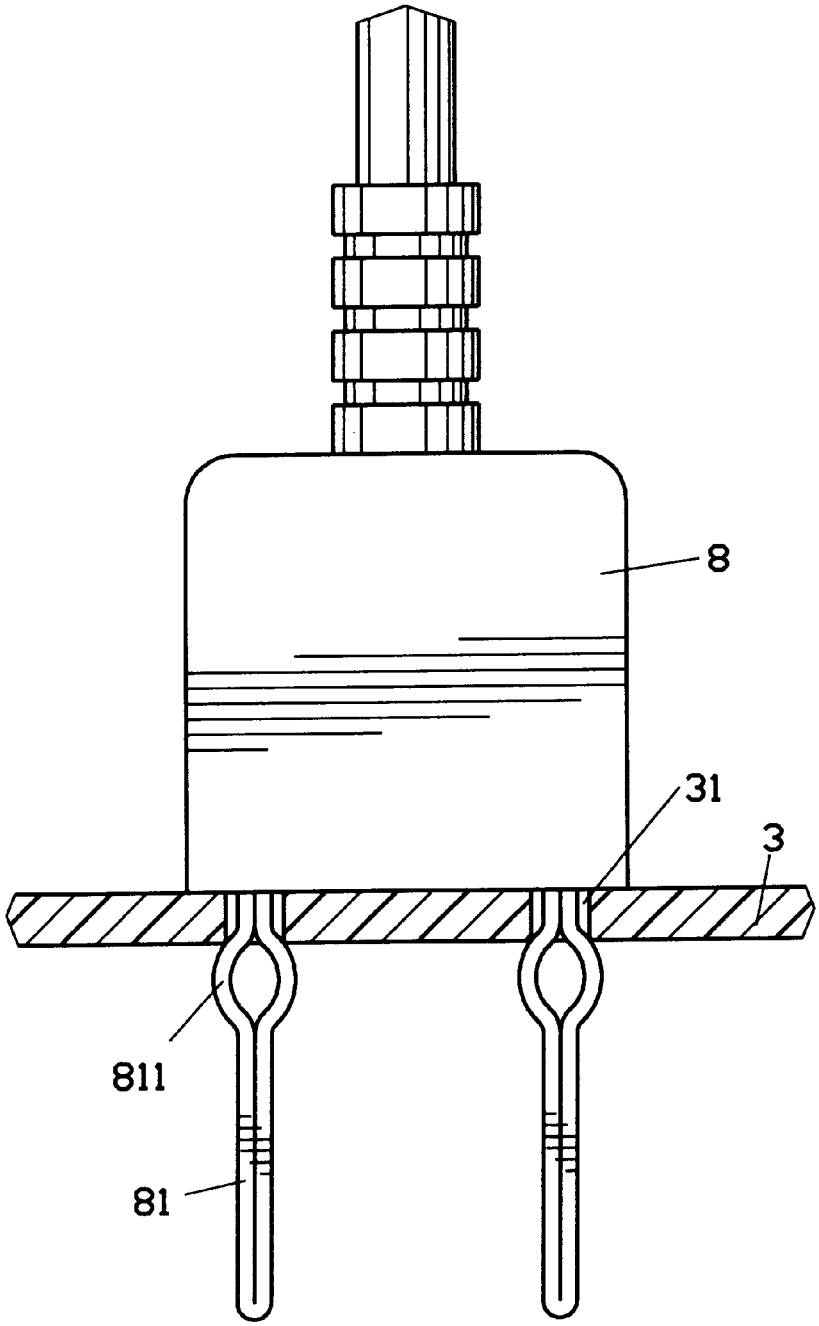
FIG. 19 is a schematic view of the ninth embodiment of the present view.
Figure 20:
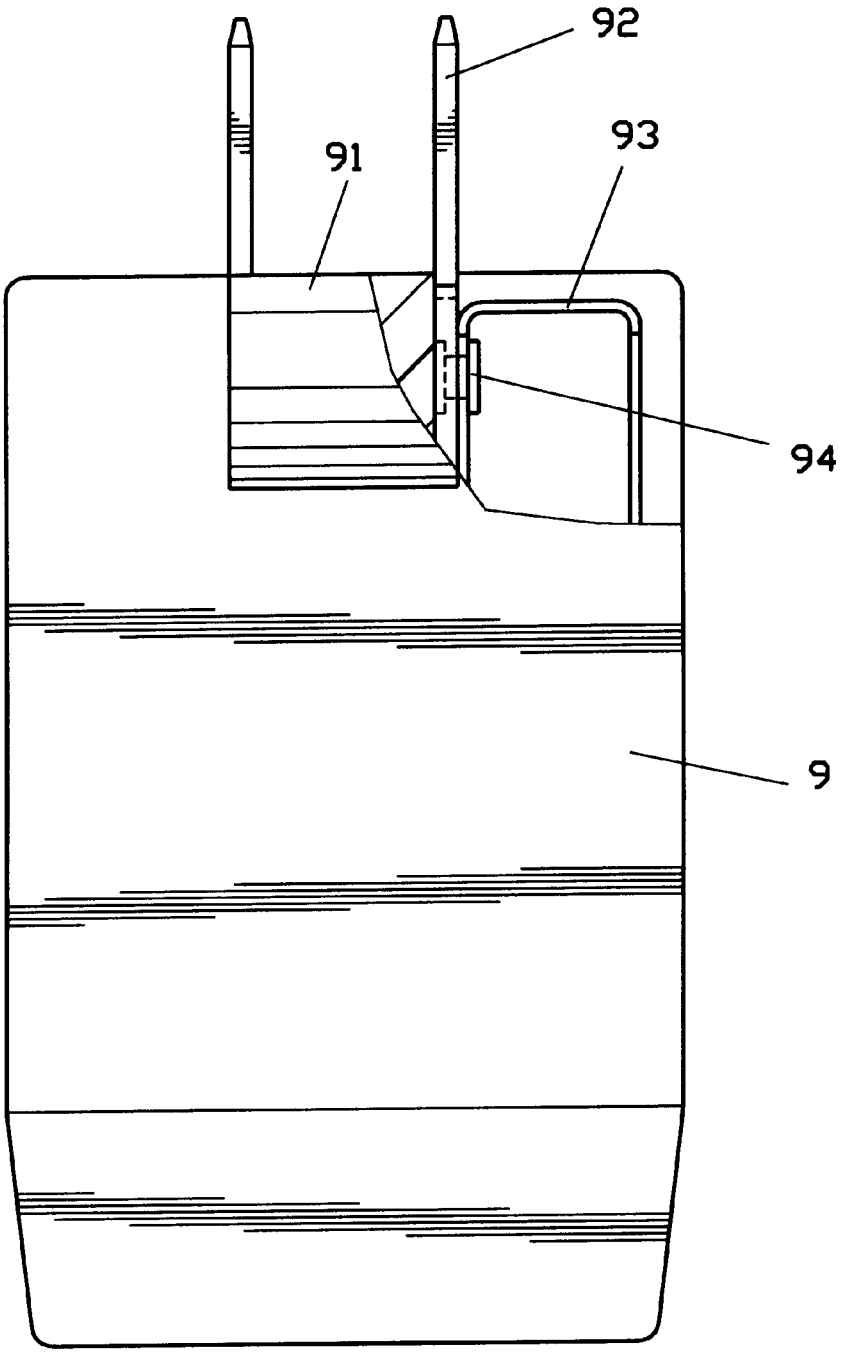
FIG. 20 (PRIOR ART)
FIG. 20 is a (partially sectional) view of the prior art as assembled.
Figure 21:
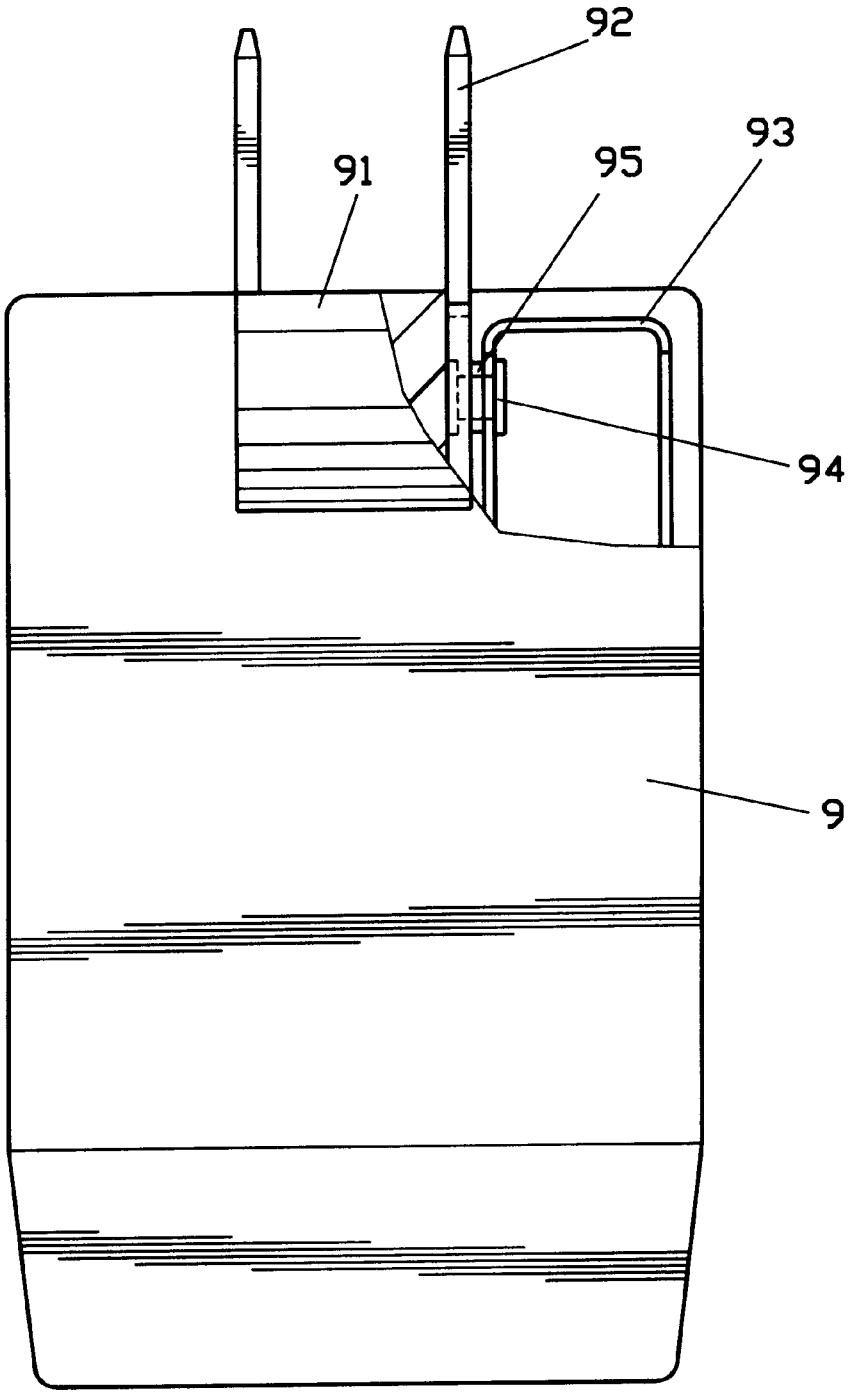
FIG. 21 (PRIOR ART)
FIG. 21 is a (partially sectional) view of another type of the prior art as assembled.

Furthermore, as illustrated in FIG. 18, the plug(7) of the present invention can be provided with a convex buckling wall(711) by pressing at the wider edge of the blade(71) on one side and said buckling wall(711) may be made as a local protruding nip or pressed for a protrusion by taking advantage of the area on the middle section of the blade(71); on the other side of the blade(71), a gap(712) is provided to facilitate receiving the resilient leaf(2) and said buckling wall(711) from the blade(71) may hold against the wall of the outlet(31) to hold the blade(71) in position; in addition, as illustrated in FIG. 19, buckling walls(811) are formed by pressing at two respective sides of a sheet material and said sheet material is folded inwardly to from a blade(81) while two buckling walls(811) are matched and respectively to protrude the buckling walls(811) on internal and external sides to the wider edge of the blade(81); so that when the blade(81) is inserted into the outlet(31) of the socket(3), said buckling wall(811) just holds against the inner wall of the outlet(31) for providing the same positioning effects.

The blade of a plug in the present invention relates to any type of blade in any form that can be inserted into a socket, including but not limited to a plug to a transformer, adapter socket for lightening, etc.

What is claimed is:

1. An electric plug assembly for securely engaging an electric socket assembly comprising:

(a) a plug body;

(b) at least a pair substantially flat of blades extending longitudinally from said plug body, each said blade having a pair of laterally opposed edge portions, each said edge portion having formed therein an intermediate notched gap section; and, (c) a plurality of resilient members respectively coupled to said blade edge portions, each said resilient member having a terminal end deflectively received in said gap section of said edge portion and an intermediate protrusion resiliently biased to protrude laterally outward therefrom;

said resilient members each being adapted for resilient deflection to a predetermined configuration within said gap section during passage of said blades through the socket assembly, said resilient member protrusions each being disposed relative to said blade edge portion laterally in substantially flush manner when in said predetermined configuration.

2. The electric plug assembly as recited in claim 1 wherein each said edge portion of said blades has formed thereon a recess longitudinally offset from said gap section, and each said resilient member includes a groove engaging said blade recess for reinforcing said coupling of said resilient member and said blade.

3. The electric plug assembly as recited in claim 1 wherein said resilient members coupled to said edge portions of a common one of said blades extend from an integrally formed resilient leaf structure, said resilient leaf structure having a substantially U-shaped configuration.

4. The electric plug assembly as recited in claim 1 wherein said protrusion of at least one said resilient member is resiliently biased to an arcuate contour.

5. The electric plug assembly as recited in claim 1 wherein said protrusion of at least one said resilient member is resiliently biased to a contour having an intermediate angular bend.

6. The electric plug assembly as recited in claim 1 wherein each said blade has formed thereon a pair of longitudinally extending sectional grooves respectively communicating with said gap sections thereof.

7. The electric plug assembly as recited in claim 6 wherein each said resilient member includes a securing end section longitudinally offset from said terminal end thereof, said securing end section engaging said sectional groove of said blade.

8. The electric plug assembly as recited in claim 7 wherein each said resilient member is formed having substantially a wire construction.

9. An electric plug assembly for securely engaging an electric socket assembly comprising:

(a) a plug body;

(b) at least a pair substantially flat of blades extending longitudinally from said plug body, each said blade having a pair of laterally opposed edge portions, each said edge portion having formed therein an intermediate notched gap section; and, (c) a plurality of resilient members integrally formed on said blade edge portions, each said resilient member having a terminal end deflectively received in said gap section of said edge portion and an intermediate protrusion resiliently biased to protrude laterally outward therefrom;

each said gap section of said blades being configured to maintain sufficient clearance for resilient deflection therein to a predetermined configuration of one said resilient member during passage of said blades through the socket assembly, said resilient member protrusions each being disposed in said predetermined configuration in substantially flush manner laterally relative to said blade edge portion.

10. An electric plug assembly for securely engaging an electric socket assembly comprising:

(a) a plug body;

(b) at least a pair substantially flat of blades extending longitudinally from said plug body, each said blade having a pair of laterally opposed edge portions, each said edge portion having formed therein an intermediate notched gap section, each said blade having a through hole formed therein; and, (c) a covering leaf coupled to at least one of said blades, said covering leaf having- a pair of resilient members joined one to the other by a side leaf portion, said resilient members being respectively coupled to said blade edge portions, each said resilient member having a terminal end deflectively received in said gap section of said edge portion and an intermediate protrusion resiliently biased to an arcuate contour protruding laterally outward therefrom, said side leaf portion extending transversely over a portion of said blade, said side leaf having formed thereon a resilient annular protrusion defining a hole substantially aligned with said through hole of said blade;

said resilient members each being adapted for resilient deflection to a predetermined configuration within said gap section during passage of said blades through the socket assembly, said resilient member protrusions each being disposed relative to said blade edge portion laterally in substantially flush manner when in said predetermined configuration.

11. An electric plug assembly for securely engaging an electric socket assembly comprising:

(a) a plug body;

(b) at least a pair substantially flat of blades extending longitudinally from said plug body, each said blade having opposed inner and outer lateral sides, each said blade having formed in at least one of said lateral sides thereon an intermediate slotted gap section, said gap section being longitudinally extended; and, (c) at least one resilient member coupled to each of said blades, each said resilient member having a terminal end deflectively received in said gap section of said blade and an intermediate protrusion resiliently biased to protrude laterally outward therefrom, at least one said resilient member including a longitudinally extended flush section offset from said intermediate protrusion thereof, said flush section being received in said gap section of one said blade for stabilizing said resilient member;

each said resilient member being adapted for resilient deflection to a predetermined configuration within said gap section during passage of said blades through the socket assembly, each said resilient member protrusion being disposed relative to said blade in substantially flush manner laterally when in said predetermined configuration.

12. The electric plug assembly as recited in claim 10 wherein each said resilient member is resiliently biased to protrude laterally outward from said inner lateral side of said blade.

13. The electric plug assembly as recited in claim 11 wherein each said resilient member is resiliently biased to protrude laterally outward from said outer lateral side of said blade.

14. The electric plug assembly as recited in claim 11 wherein each said gap section extends laterally between said inner and outer lateral sides of said blade.

15. The electric plug assembly as recited in claim 11 wherein each said resilient member is integrally joined to one said blade.

16. The electric plug assembly as recited in claim 11 wherein at least one said blade includes at least a pair of said resilient members coupled thereto to respectively protrude laterally outward from said inner and outer lateral sides.

17. The electric plug assembly as recited in claim 11 wherein at least one of said resilient members is reconfigurable in said resilient bias thereof.

* * * * *